US006274798B1

(12) United States Patent
Suzuki et al.

(10) Patent No.: US 6,274,798 B1
(45) Date of Patent: Aug. 14, 2001

(54) APPARATUS FOR AND METHOD OF SETTING CORRESPONDENCE BETWEEN PERFORMANCE PARTS AND TRACKS

(75) Inventors: Satoshi Suzuki; Takeo Shibukawa, both of Hamamatsu (JP)

(73) Assignee: Yamaha Corporation (JP)

( * ) Notice: Subject to any disclaimer, the term of this patent is extended or adjusted under 35 U.S.C. 154(b) by 0 days.

(21) Appl. No.: 09/493,391

(22) Filed: Jan. 28, 2000

(30) Foreign Application Priority Data

Feb. 2, 1999 (JP) ..... 11-024854

(51) Int. Cl.[7] ..... G10H 1/18

(52) U.S. Cl. ..... 84/615; 84/477 R

(58) Field of Search ..... 84/615–620, 477 R, 84/478

(56) References Cited

U.S. PATENT DOCUMENTS 5,821,444 * 10/1998 Yamaura ..... 84/615 X

* cited by examiner

*Primary Examiner*—Stanley J. Witkowski
(74) *Attorney, Agent, or Firm*—Morrison & Foerster

(57) ABSTRACT

Settings of a table as to correspondence between performance parts and tracks can be changed as desired through operation by a user. If the settings of the table have been changed when a visual performance guide is to be provided for a given performance part, the changed settings are automatically referred to so that performance data of a particular track related with the given performance part is selected and used for the performance guide. Namely, whenever the settings of the table are changed, corresponding relationship between tracks and performance parts can be newly set in an automatic fashion, so that it is possible to eliminate a need for a user to repeat a same cumbersome changing operation each time an automatic performance is to be initiated.

23 Claims, 5 Drawing Sheets

APPARATUS FOR AND METHOD OF SETTING CORRESPONDENCE BETWEEN PERFORMANCE PARTS AND TRACKS

BACKGROUND OF THE INVENTION

The present invention relates generally to electronic musical instruments or tone generators which allow a performance assisting function, such as a so-called key depression guide function, to be provided for a desired performance part. More particularly, the present invention relates to an apparatus and method which can properly associate or relate appropriate performance data (i.e., track-by-track performance data trains) with a plurality of performance parts, to thereby set an appropriate correspondence between the performance tracks and the performance parts.

In recent years, electronic musical instruments have been known extensively which have additional functions of not only executing an automatic performance in accordance with previously-provided automatic performance data but also providing a visual performance assistance or guide to sequentially indicate keys to be depressed in accordance with progression of a performance (hereinafter called a "key depression guide function") so that even a beginner can perform a desired music piece. Typical examples of the key depression guide function employed in piano-type electronic musical instruments include a function of sequentially indicating keys to be depressed by sequentially turning on/off light-emitting diodes (LEDs) disposed in corresponding relation to the keyboard keys, and a function of indicating key operation start timing and key operation end timing of the keys (i.e., key depression timing and key release timing) using a liquid crystal display screen provided on the electronic musical instrument.

The electronic musical instruments of the above-mentioned type are normally designed to selectively activate the key depression guide function for either one or both of a right-hand performance part (corresponding to a melody performance) and a left-hand performance part (corresponding to a chord performance). In performance practice with the key depression guide function activated, each performance part selected as a subject of the key depression guide function is set to a "mute" condition, i.e., a condition where only visual indication of keys to be depressed is given via the key depression guide function with no tone generated at all by the automatic performance function for that selected performance part; in this case, however, tones are generated via the automatic performance function for every other performance part not selected as a subject of the key depression guide function as well as for every accompaniment part. In this way, a user or human player is allowed to practice a manual performance of the desired performance part while listening to the actually-generated tones of the other parts.

Automatic performance data used for the above-mentioned functions generally comprise event data indicative of tone generation and tone deadening events (turning on/off of tones) and timing data indicative of respective tone generating timing of the individual events, which are pre-recorded for each of a plurality of performance parts in a predetermined tone progression order. To each of the event data is added track number data indicating which of the performance parts that event data belongs to. The conventional piano-style musical instruments are also arranged to properly activate the aforementioned key depression guide function by relating the track numbers with the performance parts in such a way that the event data with a track number "1", for example, is regarded as the data of the right-hand performance part (such relationship or correspondence of the track numbers with the performance parts will hereinafter be called "track assignment"). However, to date, there has been no unified standard for such correspondence between the track numbers and the performance parts; the standard differs variously among various manufactures of musical instruments. As a consequence, there would occur the problem that even the same event data with a particular track number is interpreted as data of the right-hand performance part in the musical instrument of one manufacturer but as data of the left-hand performance part in the musical instrument of another manufacturer, and vice versa.

To avoid such a problem, more sophisticated piano-style musical instruments are constructed to set appropriate correspondence between the tracks and the performance parts, by prestoring information representing such a track-to-part correspondence (this information will hereinafter be called a "track assignment table") of each individual manufacturer. Thus, each time instructions for reading out new automatic performance data are given, these musical instruments operate to set a track-to-part correspondence by making reference to one of the prestored track assign tables in accordance with which of the manufactures the new automatic performance data pertains to (i.e., which of the manufactures created that new automatic performance data).

In some cases, however, even a single musical instrument manufacture is using two or more different sets of track assignment settings. Therefore, the prestored track assignment table can not always permit appropriate setting of track assignment for all the automatic performance data, in which case there would arise a need for the user or human player to manually make new track assignment settings. Conventionally, the thus-manually make new track assignment settings are never stored for subsequent use, and thus, whenever the user has selected another music piece to be automatically performed, the manually-made track assignment settings are cleared to be replaced by any one of the prestored sets of track assignment settings. Because the track assignment table also contains "substitute" track assignment state information that is applicable to any other manufacturer than those pre-registered in the table, it has been conventional for a certain track assignment setting operation to be carried out on every new music piece selected. Accordingly, the manual track assignment setting operation must be carried out upon readout of each automatic performance data set for which no appropriate track assignment information has not been pre-recorded in the track assignment table. Consequently, even when automatic performance data, all recorded in a same recording format, are to be read out in succession, a new track assignment setting operation must be made by the user unless the track assignment table includes track assignment information corresponding to that particular recording format, which would require a very cumbersome and time-consuming operation by the user.

SUMMARY OF THE INVENTION

It is therefore an object of the present invention to provide a music-performance setting apparatus and method which allow performance data of appropriate tracks to be properly related with a plurality of performance parts through a very simple operation by a player.

In order to accomplish the above-mentioned object, the present invention provides a music-performance setting apparatus which comprises: a memory storing performance data of a plurality of performance parts with each of the performance parts associated or related with any of a plurality of tracks; a table representing settings as to correspondence (i.e., corresponding relationship) between the performance parts and the tracks; an operator unit; and a processor coupled with the memory, the table and the operator unit. The processor is arranged to change the settings of the table in response to operation of the operator unit.

The music-performance setting apparatus of the present invention may further comprise a display coupled to the processor, and the processor may be arranged to show the settings of the table on the display so that a user is allowed to change the settings of the table by operating the operator unit while viewing the settings shown on the display.

Further, the processor may be arranged to perform control to read out the performance data of individual ones of the tracks from the memory and relate the performance data of the individual tracks, read out from the memory, to respective ones of the performance parts with reference to the settings of the table.

Furthermore, the processor may be arranged to receive performance-part designating information entered by the user and then select the performance data of a given track corresponding to a performance part designated by the performance-part designating information, from among the performance data of the individual tracks read out from the memory, with reference to the settings of the table.

According to the present invention, the settings of the table pertaining to the correspondence between the performance parts and the tracks can be changed as desired through operation of the operator unit by the user. If the settings of the table have been changed in the aforesaid manner when a visual performance guide is to be provided for a given performance part, the changed settings are automatically referred to so that the performance data of a particular track related with the given performance part is selected and used for the performance guide. Thus, the performance data of the individual tracks read out from the memory can be properly related with the respective performance parts, and the changed settings can be reproduced, whenever necessary, by just referring to the table. This arrangement can eliminate a need for the user or player to repeat a same changing operation each time an automatic performance is to be initiated, thereby significantly simplifying the user operation. Namely, as the settings of the table are changed in the above-mentioned manner, corresponding relationship between the tracks and the performance parts can be newly set in an automatic fashion, so that it is possible to eliminate the need for the user to repeat the same cumbersome changing operation each time an automatic performance is to be initiated. Further, with the present invention, the user can select a desired performance part for which a visual performance guide is to be provided, by just designating the name of the "performance part" that is easy to recognize musically instead of its corresponding "track" that is much more difficult to recognize musically.

The present invention may be constructed and implemented not only as the above-mentioned apparatus invention but also as a method invention. The present invention may also be arranged and implemented as a computer program, as well as a machine-readable storage medium storing such a computer program.

BRIEF DESCRIPTION OF THE DRAWINGS

For better understanding of the object and other features of the present invention, its preferred embodiments will be described in greater detail hereinbelow with reference to the accompanying drawings, in which.

DETAILED DESCRIPTION OF THE PREFERRED EMBODIMENTS

Figure 2:
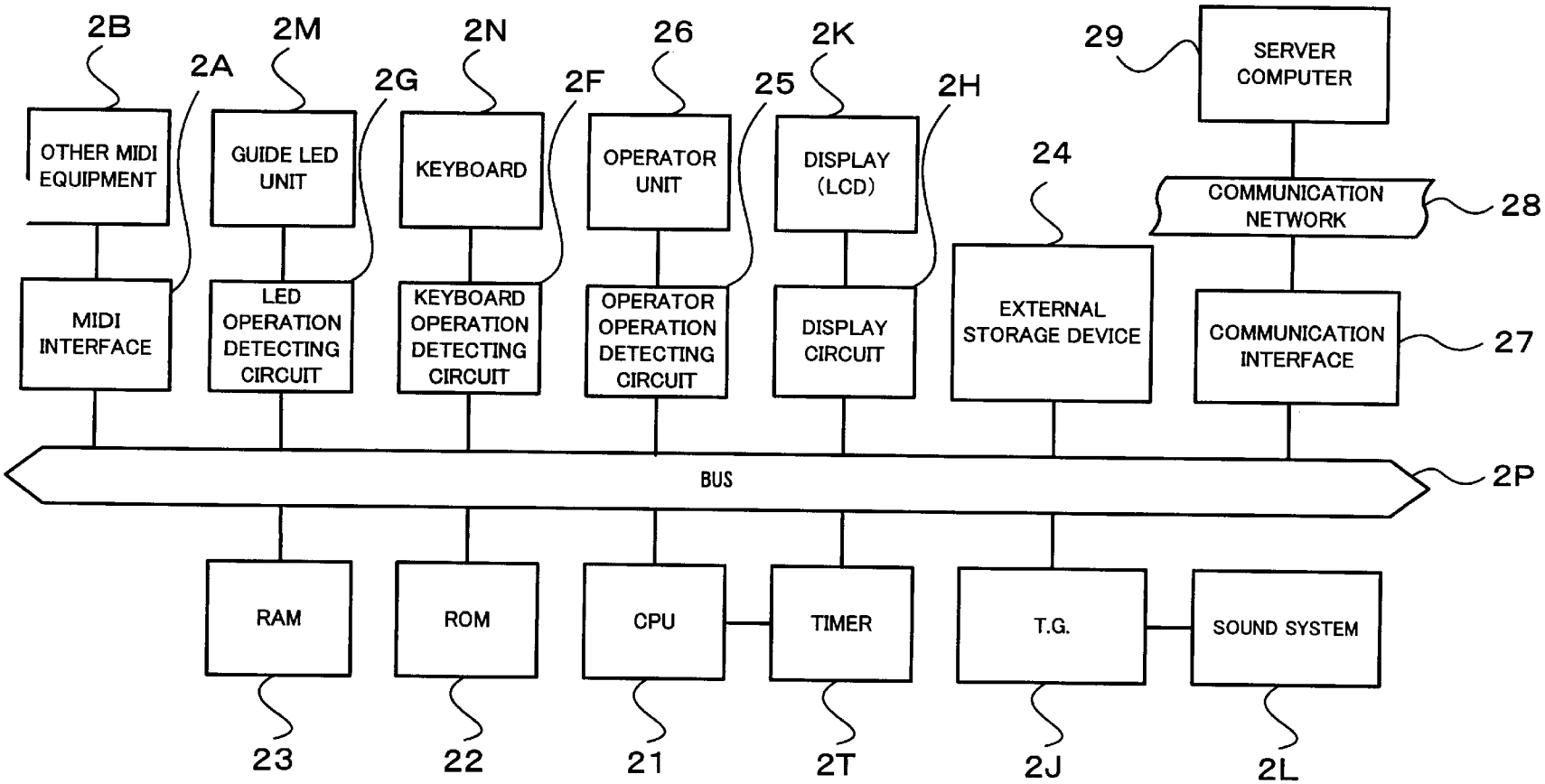
FIG. 2 is a block diagram showing a general hardware setup of the electronic musical instrument containing a music-performance setting apparatus in accordance with a preferred embodiment of the present invention.

FIG. 2 is a block diagram showing a general hardware setup of an electronic musical instrument which operates under control of a music-performance setting apparatus in accordance with a preferred embodiment of the present invention. The behavior of the electronic musical instrument is controlled by a CPU 21. To the CPU 21 are connected, via a data and address bus 2P, a read-only memory (ROM) 22, a random access memory (RAM) 23, an external storage device 24, an operator operation detecting circuit 25, a communication interface 27, a MIDI interface 2A, a key depression detecting circuit 2F, an LED operation detecting circuit 2G, a display circuit 2H and a tone generator (T.G.) circuit 2J. For convenience, the following description will be made in relation to a case where only minimum necessary resources are used, although the electronic musical instrument may of course include any other hardware components as necessary.

In the electronic musical instrument, the CPU 21 performs various processing based on various software programs and data stored in the ROM 22 and RAM 23 and automatic performance data supplied from the external storage device 24. In the illustrated example, the external storage device 24 may comprises one or more of a floppy disk drive (FDD), hard disk drive (HDD), CD-ROM drive, magneto optical (MO) disk drive, ZIP drive, PD drive, DVD (Digital Versatile Disk) drive, etc. Song data and the like may be received from other MIDI equipment 2B or the like via the MIDI interface 2A. The CPU 21 supplies the tone generator circuit 2J with the song data thus given from the external storage device 24, and the tone generator circuit 2J generates tone signals on the basis of the song data, each of which is audibly reproduced or sounded via an external sound system 2L including an amplifier and speaker.

The ROM memory 22 has prestored therein various programs, including system-related programs, for execution by the CPU 21, as well as various parameters and data. In the preferred embodiment, a basic "track assignment table" is prestored in the ROM 22 along with operating programs for automatic performance processing etc.

The RAM memory 23 has two major functions: a working memory function for temporarily storing various data occurring as the CPU 21 executes the programs; and a data memory function for storing various other data, which are allocated in predetermined address regions of the RAM 23 and used as registers, flags, etc. In the preferred embodiment, changed track assignment tables, obtained by changing the basic track assignment table, are also stored in the RAM 23. Desired operating program, various data and the like may be prestored in the external storage device 24, such as the CD-ROM drive, rather than in the ROM 22. The operating program and various data thus prestored in the external storage device 24 can be transferred to the RAM 23 or the like for storage therein so that the CPU 21 can operate in exactly the same way as in the case where the operating program and data are prestored in the ROM 22. This arrangement greatly facilitates version-upgrade of the operating program, installation of a new operating program, etc.

Further, the electronic musical instrument may be connected via the communication interface 27 to a communication network 28 such as a LAN (Local Area Network), the Internet or telephone line network to exchange a desired operating program and data with a desired sever computer 29, in which case the operating program and various data can be downloaded from the server computer 29. In such a case, the electronic musical instrument, which may be a "client" personal computer, sends a command to request the server computer 29 to download the operating program and various data by way of the communication interface 27 and communication network 28. In response to the command from the electronic musical instrument, the server computer 29 delivers the requested operating program and data to the electronic musical instrument via the communication network 28. The electronic musical instrument receives the operating program and data via the communication interface 27 and stores them into the hard disk 24, RAM 23 or the like. In this way, the necessary downloading of the operating program and various data is completed.

Note that the present invention may be implemented by a general-purpose personal computer or the like where are installed the operating programs and song data corresponding to the functions of the present invention, rather than by a dedicated electronic musical instrument. Alternatively, the present invention may be implemented by karaoke equipment, electronic game apparatus, multimedia equipment or the like, in which case, the operating programs, song data and the like corresponding to the present invention may be supplied to users in the form of a storage medium, such as a CD-ROM and floppy disk, that is readable by a computer or processor.

Figure 3:
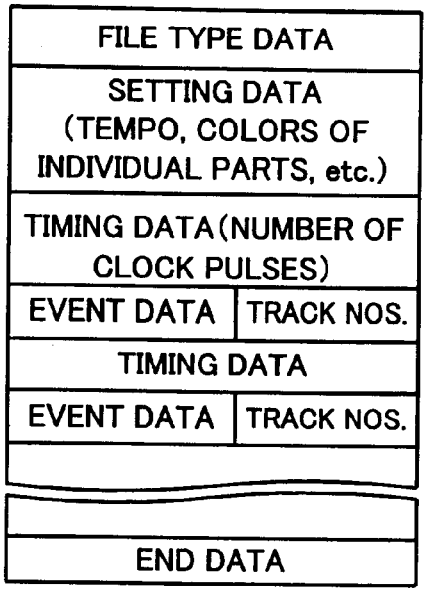
FIG. 3 is a conceptual diagram showing an exemplary organization of song data employed in the electronic musical instrument of FIG. 2.

The following paragraphs describe in detail the song data and track assignment table. FIG. 3 shows an exemplary organization of the song data. As shown, the song data is made up of file type data, various setting data pertaining to tone colors, tempos, effects, etc. of individual performance parts, timing data, various event data, track numbers and end data indicative of an end of a music piece in question. Although the song data, of course, includes other data than the above-mentioned, these other data will not be described here because they are not essential to the present invention.

The "file type data" is added to each of the song data to indicate a recording format of the song data, i.e., identify a manufacturer to which the song data belongs to, and serves as index data in consulting or making reference to a later-described track assignment table. The "various setting data" are data pertaining to various parameters that must be set previously in order to execute an automatic performance; these setting data are data pertaining to, for example, setting of a tempo of the music piece and tone colors, effects, etc. of the individual performance parts. The "event data" are performance event data such as key-on data indicative of a tone generation event and key-off data indicative of a tone deadening event. Each of the event data is used in combination with the timing data which is time data (i.e., duration data) indicative of a time interval between adjacent performance event data. The song data, however, may be in any other format, such as: the "event plus absolute time" format where the time of occurrence of each performance event is represented by an absolute time within the music piece or a measure thereof; the "event plus relative time" format where the time of occurrence of each performance event is represented by a time interval from the immediately preceding event; the "pitch (rest) plus note length" format where each performance data is represented by a pitch and length of a note or a rest and a length of the rest; or the "solid" format where a memory region is reserved for each minimum resolution of a performance and each performance event is stored in one of the memory regions that corresponds to the time of occurrence of the performance event. The track number is attached to each of the event data and indicates a particular track (performance part) to which the event data belongs. The preferred embodiment will be described in relation to a case where the event data are prestored sequentially in order in which the event data are to be output without regard to the tracks to which they are allocated. However, the present invention is not so limited, and the song data may be organized in such a manner that the event data are stored independently on a track-by-track basis.

Figure 4:
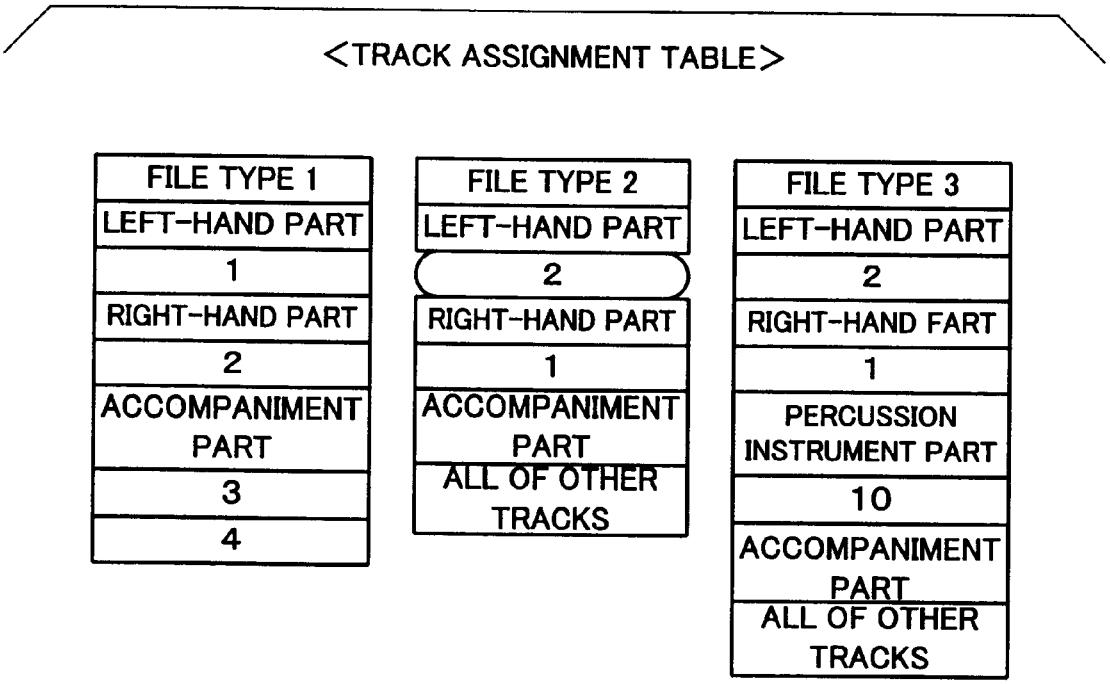
FIG. 4 is a conceptual diagram showing exemplary contents of a track assignment table employed in the electronic musical instrument of FIG. 2.

FIG. 4 shows exemplary contents of the track assignment table storing correspondence (corresponding relationship) between the performance parts and the track numbers.

The track assignment table is provided for each file type to indicate particular tracks with which various performance parts, such as a left-hand performance part, right-hand performance part, accompaniment part and percussion instrument part, are related. The "file type" in the track assignment table is index type data identical in nature to the one in the song data. Describing the leftmost track assignment table of FIG. 4, i.e., the table of file type 1, the left-hand performance part is related with track number "1", the right-hand performance part is related with track number "2", and the accompaniment part is related with track numbers "3" and "4". It should be obvious that these track assignment tables may be prepared such that the number of the tracks differs among the file types.

Referring back to FIG. 2, the tone generator circuit 2J, which is capable of simultaneously generating tone signals in a plurality of channels, receives various event data supplied via the data and address bus 2P and generates tone signals based on these received information. The tone generation channels to simultaneously generate a plurality of tone signals in the tone generator circuit 2J may be implemented by using a single circuit on a time-divisional basis or by providing a separate circuit for each of the channels. In executing an automatic performance, certain ones of the channels are assigned to generation of tones corresponding to the performance tracks. Further, any tone signal generation scheme may be used in the tone generator circuit 2J depending on an application intended. Each of the tone signals output from the tone generator circuit 2J is audibly reproduced through the sound system 2L. In the illustrated example, the tone generator circuit 2J itself contains an effect circuit (not shown) for imparting various effects to the tone signals generated by the tone generator circuit 2J; however, such an effect circuit may be provided separately from the tone generator circuit 2J. Timer 2T generates tempo clock pulses to be used for measuring a designated time interval or setting a reproduction tempo of music piece information. The frequency of the tempo clock pulses generated by the timer 2T is adjustable via a tempo switch (not shown). The tempo clock pulse from the timer 2T is given to the CPU 21 as an interrupt instruction, so that the CPU 21 interruptively carries out various operations for an automatic performance.

Guide LED unit 2M comprises a plurality of light-emitting diodes (LEDs) to be used as a keyboard performance guide. These LEDs are provided in corresponding relation to keys of a keyboard 2N of the electronic musical instrument. The LED operation detecting circuit 2G turns on and off designated ones of the LEDs to thereby inform the player of keyboard keys to be depressed and timing of the key depression. The LED operation detecting circuit 2G also determines whether or not there is a proper match between the instructed keys and the player-depressed keys.

Operator unit 26 of FIG. 2 includes various operators, such as keys and switches, for setting various parameters. For convenience, the preferred embodiment of the present invention will be described in relation to a specific case where the operator unit 26 includes automatic performance switches, mute switch, etc. The operator operation detecting circuit 25 constantly detects respective operational states of the individual switches on the operator unit 26 and outputs operator operation information, representative of the detected operational states, to the CPU 21 via the data and address bus 2P. Display 2K in the illustrated example comprises an LCD (Liquid Crystal Display) or the like and is controlled by the display circuit 2H.

Figure 5:
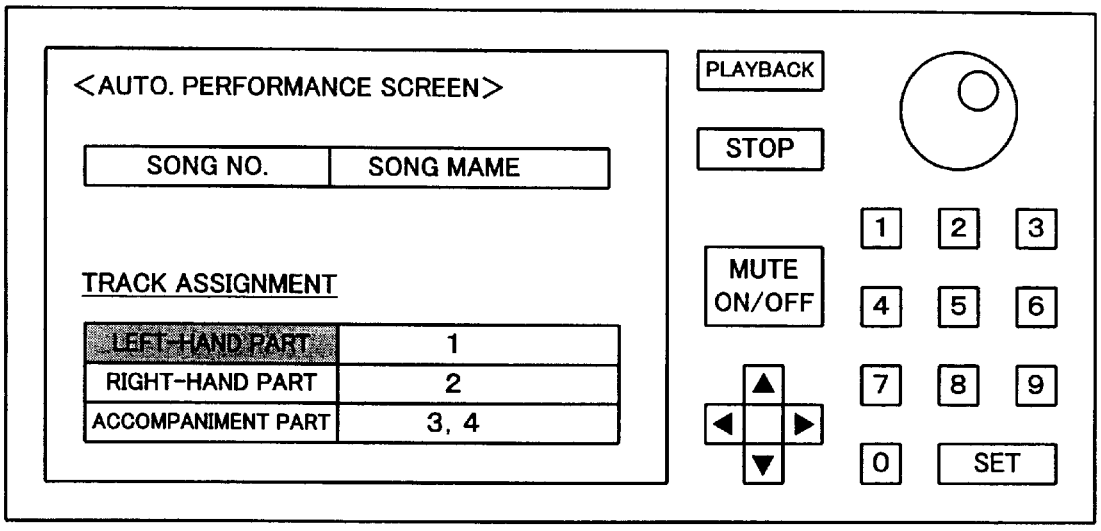
FIG. 5 is a diagram showing an exemplary external arrangement of an operation panel employed in the electronic musical instrument of FIG. 2.

FIG. 5 is a diagram showing an exemplary external arrangement of an operation panel, on which are provided the above-mentioned LCD and various switches such as the automatic performance switches and mute switch.

More specifically, the screen of the LCD is disposed, on the left half of the operation panel, to display track assignment state information along with music piece information such as a number (song number) and name (song name) of a music piece to be automatically performed. The track assignment state information, thus displayed on the LCD screen, indicates which of the tracks the individual performance parts, such as the right-hand performance part, left-hand performance part and accompaniment part, are related with. It should be obvious that any other performance information, such as lyrics and score of the music piece, may be displayed on the LCD screen. On the right half of the operation panel, there are provided various automatic-performance-related operators, of which "PLAYBACK" and "STOP" switches are automatic performance switches for the player to give instructions for starting and stopping an automatic performance. "MUTE ON/OFF" switch can be used by the player to give instructions for muting a desired performance part. Numeric keys are provided for entering a song number to designate song data that is to be automatically performed or changing a track number in the track assignment state information. Directional keys are provided for moving a cursor to a desired position on the LCD screen when given song data is to be designated or a given track number is to be changed. "SET" switch is for setting the cursor position and user-entered track number.

Figure 1:
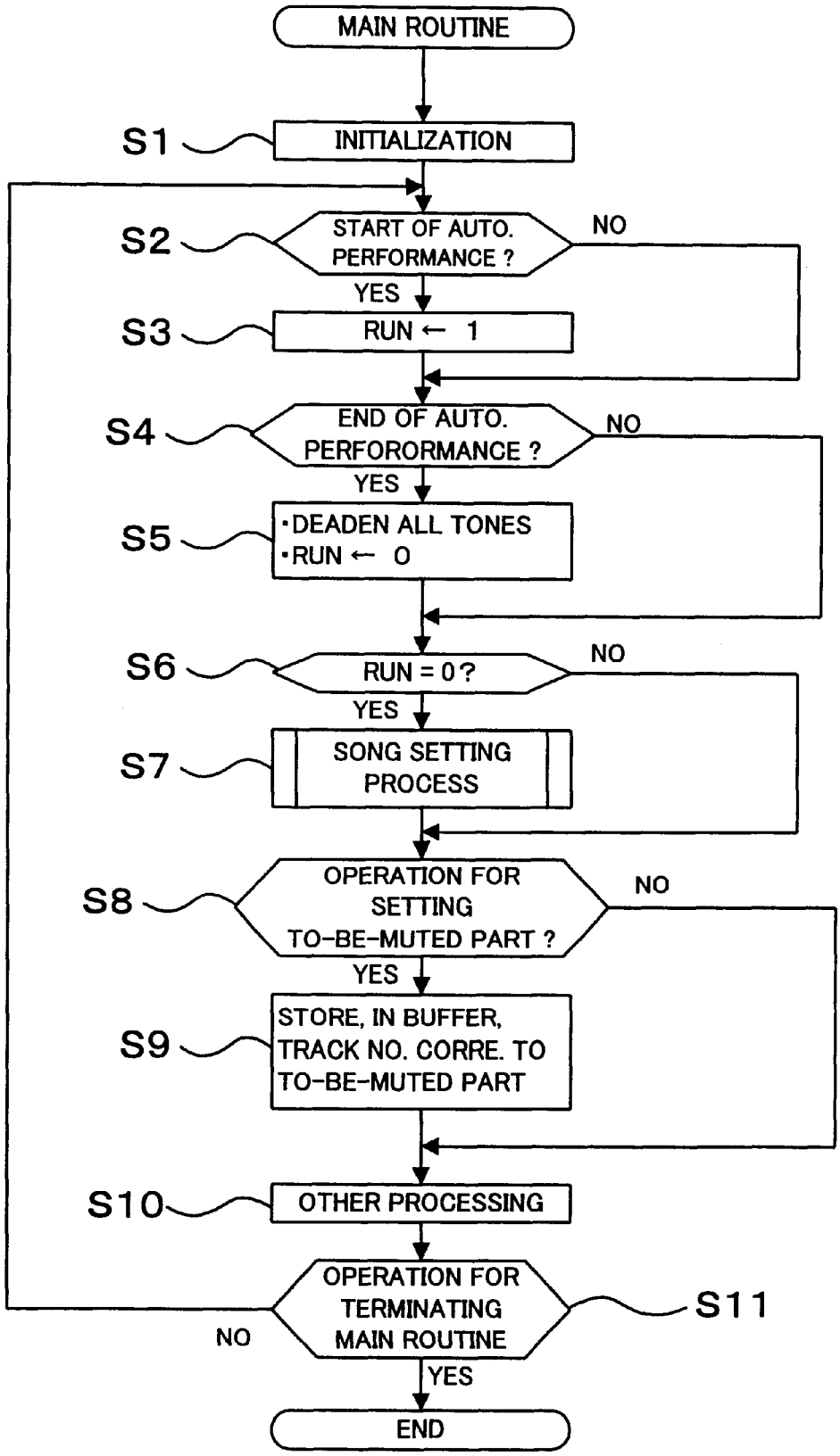
FIG. 1 is a flow chart explanatory of an exemplary processing flow of a main routine that is carried out by an the electronic musical instrument of the present invention when the musical instrument is caused to function as an automatic performance apparatus.

FIG. 1 is a flow chart explanatory of an exemplary processing flow of a main routine carried out by the CPU 21 in the electronic musical instrument. This main routine is initiated by turning on a main power supply to the electronic musical instrument and terminated by turning off the main power supply. The following paragraphs describe an exemplary operational sequence of the main routine with reference to the flow chart of FIG. 1. For convenience, the main routine will be described in relation to a case where the file type data of the song data is "file type 1".

At first step S1 of the main routine, a predetermined initialization process is carried out, where predetermined initial values are set into various registers and flags and various buffers are reset or cleared in the RAM 23 of FIG. 2. More specifically, a value "0" is set into a RUN flag and MUTE, L (left hand) PART, R (right hand) PART and ORCHE PART buffers are reset. These flags and buffers will be explained later in relation to operations of steps corresponding thereto. Further, at step S1, an initial screen is displayed on the LCD of the operation panel.

Upon completion of the initialization process, the main routine goes to step S2, where a determination is made as to whether or not a user or player has made operation to give instructions for starting an automatic performance, i.e., whether the "PLAYBACK" switch of FIG. 5 has been turned on by the user or player. If answered in the affirmative at step S2, a value "1" is set into the RUN flag at step S3. If, however, the player has not given instructions for starting an automatic performance, i.e., if the "PLAYBACK" switch of FIG. 5 has not been turned on, the main routine jumps to step S4. Here, the RUN flag is a flag for indicating whether or not the electronic musical instrument is currently executing an automatic performance; that is, the RUN flag at the value "1" indicates that the electronic musical instrument is currently executing an automatic performance, while the RUN flag at the value "0" indicates that the electronic musical instrument is not currently executing an automatic performance. The electronic musical instrument executes an automatic performance by causing the CPU 21 to interruptively carry out predetermined automatic performance processing during execution of the main routine. To this end, the CPU 21 determines, on the basis of the value of this RUN flag, whether execution of an automatic performance has been permitted or not, as will be later described in connection with the automatic performance processing.

At next step S4, a determination is made as to whether or not the player has made operation to give instructions for terminating an automatic performance, i.e., whether the "STOP" switch of FIG. 5 has been turned on by the player. If answered in the affirmative at step S4, all tones being currently generated are deadened or silenced and the value "0" is set into the RUN flag at step S5, so that the electronic musical instrument terminates the automatic performance and is prevented from executing an automatic performance any longer. If, however, the player has given no instructions to terminate an automatic performance, i.e., if the "STOP" switch of FIG. 5 has not been turned on, then the main routine jumps to step S6. At step S6, it is determined whether the RUN flag is currently at the value "0" or not. If the RUN flag is at the value "0" (YES), a song setting process is carried out at step S7 as will be later described. If, however, the RUN flag is not at the value "0" (NO), the main routine jumps to step S8 without carrying out the song setting process of step S7. This operation is intended to prevent the song or track assignment states from being changed by some erroneous player's operation during the course of the automatic performance, so that the song setting process of step S7 is prevented from being activated during the automatic performance.

Figure 6:
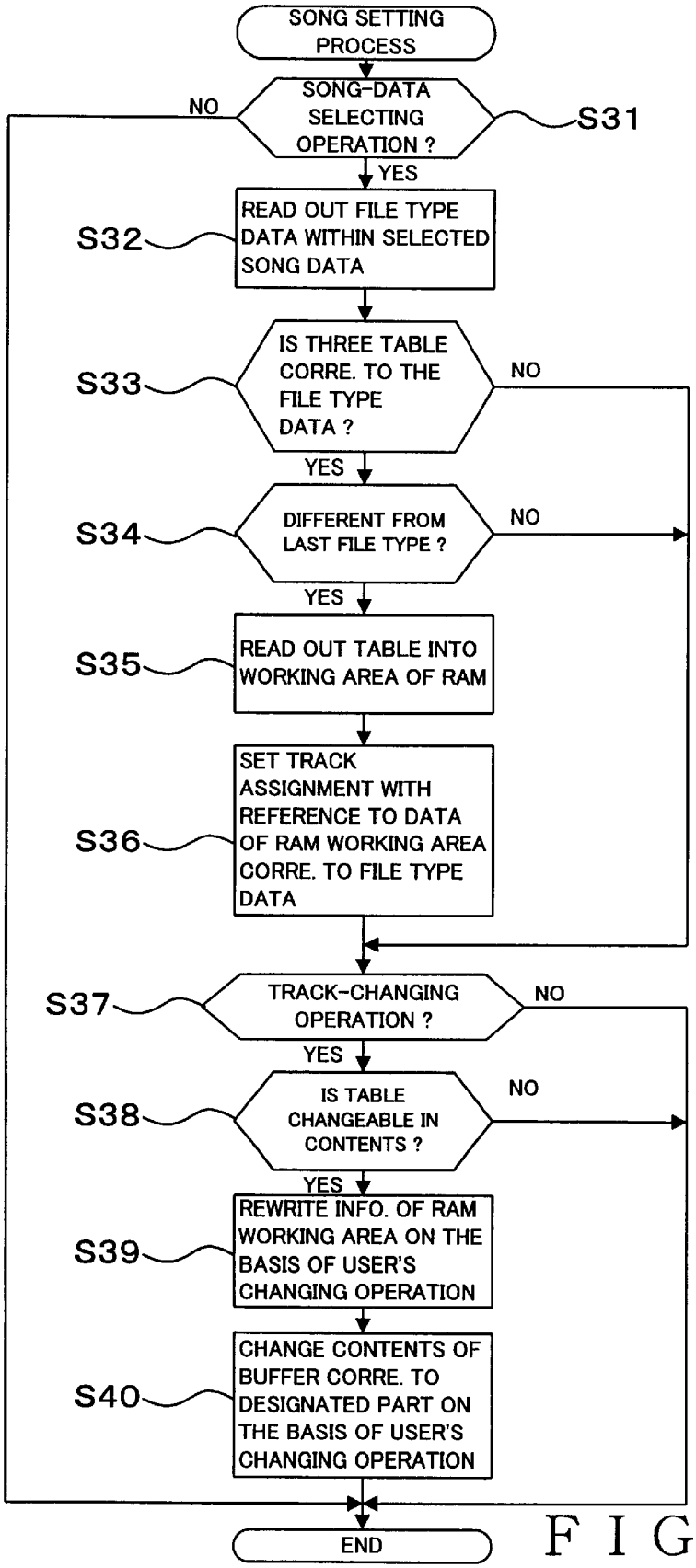
FIG. 6 is a flow chart explanatory of an exemplary processing flow of a song setting process carried out during execution of the main routine shown in FIG. 1.

FIG. 6 is a flow chart explanatory of an exemplary processing flow of the song setting process carried out at step S7 during the main routine. This song setting process is directed to assigning various tracks within song data, selected in response to a song number entered by the player, to the performance parts with reference to the track assignment table.

At first step S31 of the song setting process, it is determined whether or not a song-data selecting operation has been made by the player, and a predetermined process is carried out depending on a result of the determination. Namely, a determination is made as to whether or not a song number has been entered by the player using the numeric keys on the operation panel. If such a song-data selecting operation has been made by the player as determined at step S31, one song data corresponding to the thus-entered song number is selected from among a multiplicity of song data prestored in the external storage device 24 and displayed on the operation panel. Namely, by the player thus entering a desired song number (selecting desired song data), one song data corresponding to the entered song number is selected, from among the multiplicity of song data, to be read into predetermined working areas of the RAM and thereby set into the electronic musical instrument as data to be automatically performed. The manner of selecting desired song data is, of course, not limited to the above-mentioned; desired song data may be selected by entering the name of the desired music piece or the like.

The file type data within the selected song data is read out at next step S32, and then a determination is made at step S33 as to whether or not a track assignment table corresponding to the read-out file type data is prestored in the ROM 22. If no track assignment table corresponding to the read-out file type data is prestored in the ROM 22 as determined at step S33, the process jumps to step S37.

If, however, such a track assignment table corresponding to the read-out file type data is prestored in the ROM 22 (YES determination at step S33) and the currently read-out file type data differs from last read-out file type data (YES determination at step S34), the prestored track assignment table is read out from the ROM 22 into a working area of the RAM 23 at step S35. Namely, the track number of the track corresponding to the left-hand performance part, track number of the track corresponding to the right-hand performance part and track numbers of the tracks corresponding to the accompaniment part are read out from the track assignment table corresponding to the file type data included in the selected song data and then stored into the L PART, R PART and ORCHE PART buffers, respectively. Then, at step S36, the track assignment state for each of the performance parts is displayed, at step S36, on the operation panel with reference to the L PART, R PART and ORCHE PART buffers. If the file type data is "file type 1", track number "1" is assigned to the left-hand performance part, track number "2" is assigned to the right-hand performance part, and track numbers "3" and "4" are assigned to the accompaniment part, so that the track assignment states are displayed on the operation panel in the manner as shown in FIG. 5. In this way, different tracks are assigned to or related with the individual performance parts. If the currently read-out file type data is the same as the last read-out file type data as determined at step S34 (NO determination at step S34), the process jumps to step S37.

If a negative (NO) determination is made at step S33 or S34 in selecting a second or other subsequent song after the turning-on of the main power supply, the same track assignment table as already stored in the RAM 23 is used. Thus, in case a song of a file type which is not present in the track assignment table is selected or in case a song of the same file type as a last selected song is selected, the last track assignment state can be used for the currently selected song; as a consequence, appropriate track assignment is achieved through a very simple operation by the player. Further, if no track assignment table corresponding to the file type of the song data first selected after the turning-on of the main power supply is not prestored in the ROM 22 (NO determination at step S33), then a new track assignment table is created by assigning predetermined default tracks assigned to the individual performance parts, and the thus-created track assignment table is stored into the RAM 23 and the new track assignment state is displayed on the operation panel. Alternatively, the user is allowed to assign optionally-selected tracks to the performance parts through an assigned-track changing operation as will be later described. In the preferred embodiment, the negative determination at step S33 occurs not only in the case where the ROM 22 includes no track assignment table corresponding to the file type of the selected song data but also in a situation where the selected song data includes no file type data recorded therein.

After displaying the track assignment states on the operation panel, the process moves on to step S37 in order to determine whether or not an assigned-track changing operation has been made by the user. More specifically, step S37 checks whether the user has made an input operation to change any one of the track numbers, assigned to the performance parts (assigned-track changing operation), using the directional and numeric keys on the operation panel. If no such input operation has been made by the user to change any one of the track numbers (NO determination at step S37), the song setting process is brought to an end. If, on the other hand, such input operation has been made by the user (YES determination at step S37) and if the selected track assignment table is changeable in its settings or contents (YES determination at step S38), then the process goes to step S39 in order to rewrite, on the basis of the user's input, the stored contents or settings of any of the L PART, R PART and ORCHE PART buffers provided within the RAM 23. In case the user has also made operation to mute the performance part selected as the subject of the track number change, the process goes from step S39 to step S40 in order to rewrite stored contents of the MUTE buffer.

Here, the "track assignment table changeable in contents" refers to one that was not made in accordance with a common standard, such as a track assignment table created and distributed independently by each individual electronic musical instrument manufacturer. For such a track assignment table, each of the manufacturer ordinarily assigns tracks to individual performance parts in accordance with their own standard, and thus a user of a given manufacturer is allowed to change any one of the assigned tracks in accordance with the manufacturer's standard.

Referring back to FIG. 1, a determination is made at step S8 as to whether the user or player has made operation for setting a performance part to be muted (hereinafter called a "to-be-muted part setting operation"). Here, the "performance part to be muted" refers, for example, to a performance part for which the key depression guide function is to be activated or provided. In the preferred embodiment, the user is allowed to select a particular performance part, for which he or she desires to practice playing, by specifiying the name of the performance part rather than by the track number, by making the to-be-muted part setting operation after having selected either one or both of the left-hand performance part and right-hand performance part on the operation panel.

If the to-be-muted part setting operation has been made as determined at step S8, then the track number corresponding to the selected to-be-muted part is stored into the MUTE buffer at step S9. If the left-hand performance part is to be muted in the case where the file type data is "file type 1", track number "1" is stored into the MUTE buffer. If, however, no to-be-muted part setting operation has been made (NO determination at step S8), the process jumps over step S9 to step S10 in order to carry out other processing; that is, in this case, no track number is stored into the MUTE buffer. The "other processing" includes an editing process for adding or deleting desired data to or from the song data, and various setting processes such as for manually setting a tone color, automatic performance tempo, etc. for the entire electronic musical instrument using various switches.

After completion of the other processing at step S10, it is ascertained at step S11 whether the user has made operation to terminate the main routine, i.e., whether the main power supply to the electronic musical instrument has been turned off. If the main power supply has been turned off (YES determination at step S11), the main routine is brought to an end. If not (NO determination at step S11), the main routine loops back to step S2 in order to repeat the operations at and after step S2 and place the electronic musical instrument in a standby state. In this case, the automatic performance is continued until the automatic performance switch is turned off or the end data of the song data is read out.

Figure 7:
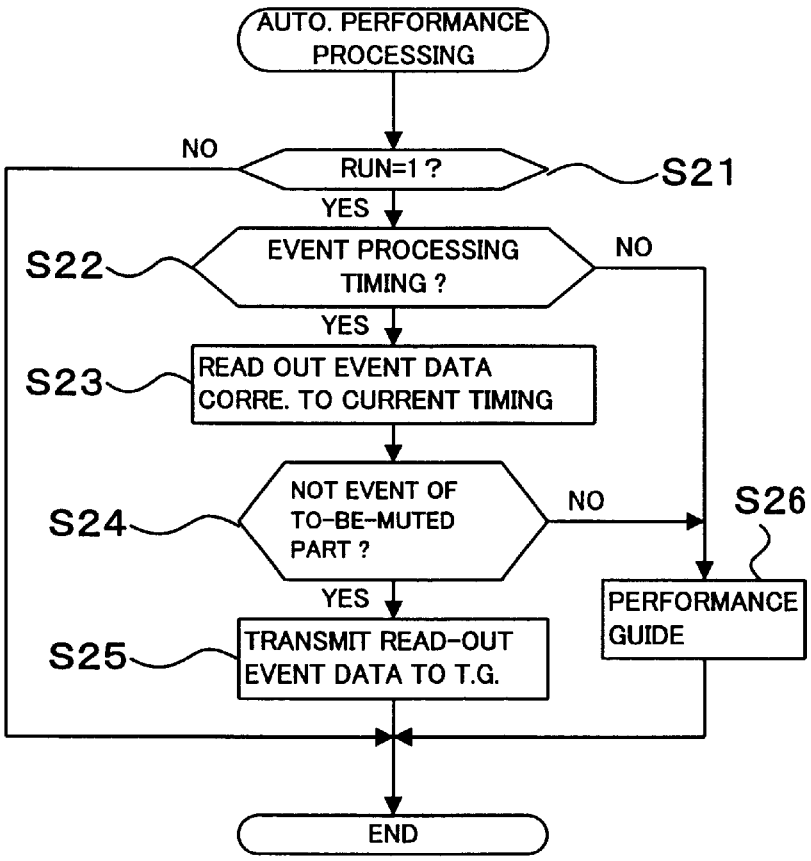
FIG. 7 is a flow chart explanatory of an exemplary processing flow of automatic performance processing that is interruptively carried out at predetermined time intervals during the main routine shown in FIG. 1.

FIG. 7 is a flow chart showing an exemplary processing flow of the automatic performance processing which is interruptively activated every predetermined clock timing (in the described embodiment, at a rate of 96 times per quarter note).

When the RUN flag is at the value "1", i.e., when an interrupt process for an automatic performance has been permitted, an affirmative (YES) determination is made at step S21, so that the automatic performance processing is carried out by the CPU 21. If a particular one of the events in the song data has come to predetermined processing timing (YES determination at step S22), the event data corresponding to the current processing timing is read out at step S23. Then, if the event data read out at step S23 is not the data of the to-be-muted part (YES determination at step S24), the read-out event data is transmitted to the tone generator circuit at step S25, so as to be sounded or performed as an automatic performance tone. If none of the events in the song data is at the predetermined processing timing (NO determination at step S22) or if the event data read out at step S23 is the data of the to-be-muted part (NO determination at step S24), the automatic performance processing is terminated without carrying out the operation of step S25, so that no automatic performance tone is generated. Because the key depression guide function is to be activated in response to the event data judged to be the data of the to-be-muted part, a key depression or performance guide process is carried out at step S26 on the basis of the readout data, which includes turning-on/off and blinking of the LEDs. Normally, in performance processing, tones pertaining to each of the event data are generated with tone colors of the performance parts corresponding to the track numbers read out in correspondence with the event data, with reference to the buffers of the individual performance parts (i.e., the L PART, R PART, ORCHE PART buffers, etc.). As well known in the art, the performance guide process involves various complicated operations such as ahead-of-time readout of the event data; however, FIG. 7 representatively illustrates such a performance guide process by the block of step S26 just for simplicity of description.

Once the track assignment states have been changed through the operations flow charted in FIGS. 1 and 6 and 7, the changed track assignment states are retained in the RAM 23 as long as the file type data remains the same, so that there is no need for the user to manually change the settings of the track assignment state each time the song data is read out. Namely, with the electronic musical instrument according to the preferred embodiment, the user or player is allowed to assign appropriate tracks to a plurality of the performance parts through a very simple manual operation. The electronic musical instrument according to the preferred embodiment affords another benefit that it can completely dispense with a cumbersome operation by the user.

Note that each time the contents or settings of the track assignment table are changed in the above-mentioned manner (see step S38 of FIG. 6), the changed settings of the track assignment tables may be stored in the RAM 2, in order to store a plurality of different sets of the user-changed track assignment settings in the RAM 2. Thus, when there arises a need to read out some track assignment table (see steps S32, S33, etc.). In response to selection of a music piece, one of the user-changed track assignment tables corresponding to the file type of the corresponding automatic performance data may be read out from the RAM 23 rather than from the ROM 22. Alternatively, the player may either read out the changed track assignment table from the RAM 23 or read out the prestored track assignment table from the ROM 22, as desired. Further, the changed track assignment table may be stored into a non-volatile memory.

Furthermore, a new track assignment table may be created by the user. Further, there may be provided a default track assignment table whose contents can not be changed by the user, and track assignment table information held in a user track assignment table may be reset to the contents of the default track assignment table. When the track assignment table information in the user track assignment table has been thus reset to the contents of the default track assignment table, the original default track assignment states before the resetting may be retained in a predetermined memory region so that the user can read out and restore the retained track assignment states as necessary.

Furthermore, whereas the preferred embodiment of the present invention has been described as using the file type data of the song data in referring to the track assignment table, a song file name extension (e.g., "USR" in a file name "****. USR"); in this case, however, a track assignment table is provided for each different extension. By thus providing user-specific track assignment tables, music performance settings unique to the user can be readily made.

The present invention may employ any type of electronic musical instrument other than the keyboard-based instrument, such as a string, wind or percussion instrument. Further, whereas the preferred embodiment of the present invention has been described in relation to the electronic musical instrument containing together the tone generator, automatic performance apparatus, etc. the present invention is not so limited and may of course be applied to a case where the tone generator, automatic performance apparatus, etc. are provided separately from each other but operatively connected with each other via communication facilities such as a MIDI interface and communication network. Further, the electronic musical instrument may comprise a combination of a personal computer and application software, in which case processing programs may be received from a storage medium such as a magnetic or optical disk or a semiconductor memory, or via a communication network.

Moreover, the present invention may be practiced in any other modifications than the above-described embodiments. Specifically, the processor employed in present invention may be a DSP (Digital Signal Processor) instead of being limited to a CPU as described in relation to the preferred embodiment, a computer or microprocessor. Alternatively, the processor may be designed to perform the same functions as the above-described preferred embodiment, using a hardware apparatus that is based on hard-wired logic comprising an IC or LSI, or gate arrays or other discrete circuits.

In summary, the present invention is arranged in such a manner that as contents or settings of a track assignment table are changed, correspondence between a plurality of tracks and a plurality of performance parts can be set in an automatic fashion in accordance with the changed contents of the table. This characteristic arrangement can advantageously eliminate the need for a user or player to make a same changing operation each time an automatic performance is to be initiated. Further, in electronic musical instruments equipped with a plurality of functions including a performance guide function or a function of muting a particular performance part, the present invention allows a player to assign or relate appropriate tracks to a plurality of performance parts through a very simple operation, with the result that the player can set or cancel the muting function for a desired performance part in a very simplified manner.

What is claimed is:

1. A music-performance setting apparatus comprising:

a memory storing performance data of a plurality of performance parts with each of the performance parts related with any of a plurality of virtual tracks which are specified by individual track information, said performance data being accompanied by identifying information;

a storage unit including a plurality of tables, each of said tables representing settings as to correspondence between the performance parts and the virtual tracks;

an operator unit; and a processor coupled with said memory, said storage unit and said operator unit, and adapted to:

change the settings of any of said tables in response to operation of said operator unit;

select one of the tables in response to said identifying information;

perform control to read out the performance data of individual ones of the virtual tracks from said memory; and relate the performance data of the individual virtual tracks, read out from said memory, to respective ones of the performance parts, with reference to the settings of the selected one of said tables.

2. A music-performance setting apparatus as claimed in claim 1 which further comprises a display coupled to said processor and wherein said processor is adapted to show the settings of at least one of said tables on said display, whereby a user is allowed to change the settings of at least one of said tables by operating said operator unit while viewing the settings shown on said display.

3. A music-performance setting apparatus as claimed in claim 1 wherein said processor is adapted to receive performance-part designating information entered by a user and then select the performance data of a virtual track corresponding to a performance part designated by the performance-part designating information, from among the performance data of the individual virtual tracks read out from said memory, with reference to the settings of said selected one of said tables.

4. A music-performance setting apparatus as claimed in claim 3 wherein said processor is adapted to perform control to generate tones, on the basis of the performance data of the individual virtual tracks read out from said memory, in such a manner that no tone is generated on the basis of the performance data of a virtual track selected in response to the performance-part designating information.

5. A music-performance setting apparatus as claimed in claim 3 which further comprises a display coupled to said processor and wherein said processor is adapted to cause said display to provide a visual performance guide display on the basis of the performance data of a virtual track selected in response to the performance-part designating information.

6. A music-performance setting apparatus as claimed in claim 1 which further comprises performance operators and performance guide display elements disposed in corresponding relation to said performance operators, and wherein said processor is adapted to select, with reference to the settings of said selected one of said tables, the performance data of a virtual track corresponding to a given performance part for which a performance guide is to be provided, from among the performance data of the individual virtual tracks read out from said memory, and said processor is also adapted to cause said display to provide a visual performance guide display on the basis of the selected performance data of the virtual track.

7. A music-performance setting apparatus as claimed in claim 1 wherein said plurality of tables differ from each other in the settings and correspond to a plurality of different file types of performance data, and wherein said processor selects one of the tables in response to said identifying information corresponding to a file type of performance data to be performed.

8. A music-performance setting apparatus as claimed in claim 1 wherein said processor is adapted to store the changed settings of one of said tables in a buffer and relate the performance data of the individual virtual tracks, read out from said memory, to respective ones of the performance parts with reference to the settings of one of said tables stored in said buffer.

9. A music-performance setting apparatus as claimed in claim 7 wherein said processor is adapted to:

transfer, to a buffer, the settings of one of the tables selected in response to said identifying information corresponding to the file type of performance data to be performed;

change the settings transferred to said buffer in response to operation of said operator unit, to cause the changed settings to be stored in said buffer; and relate the performance data of the individual virtual tracks, read out from said memory, to respective ones of the performance parts, with reference to the settings stored in said buffer.

10. A music-performance setting apparatus as claimed in claim 9 wherein even when a changeover takes place in performance data to be performed, said processor retains the changed settings stored in said buffer unless there is a change in a file type of the performance data.

11. A method of relating a plurality of performance parts and a plurality of virtual tracks with one another using a memory storing performance data of a plurality of performance parts with each of the performance parts related with any of a plurality of virtual tracks which are specified by individual track information, said performance data being accompanied by identifying information and using a plurality of tables, each of said tables representing settings as to correspondence between the performance parts and the virtual tracks, said method comprising the steps of:

changing the settings of any of said tables as to the correspondence between the performance parts and the virtual tracks;

selecting one of the tables in response to said identifying information;

performing control to read out the performance data of individual ones of the virtual tracks from said memory; and relating the performance data of individual ones of the virtual tracks, read out from said memory, to respective ones of the performance parts, with reference to the settings of the selected one of said tables.

12. A method as claimed in claim 11 which further comprises a step of controlling tone generation or visual display based on performance data, in accordance with corresponding relationship between the performance data of the individual virtual tracks and the performance parts set by said step of relating.

13. A machine-readable storage medium containing a group of instructions of a program executable by a processor for relating a plurality of performance parts and a plurality of virtual tracks with one another, said processor being coupled with a memory storing performance data of a plurality of performance parts with each of the performance parts related with any of a plurality of virtual tracks which are specified by individual track information, said performance data being accompanied by identifying information, a plurality of tables, each of said tables representing settings as to correspondence between the performance parts and the virtual tracks and an operator unit, said program comprising the steps of:

changing the settings of any of said tables as to the correspondence between the performance parts and the virtual tracks, in response to operation of said operator unit;

selecting one of the tables in response to said identifying information;

performing control to read out the performance data of individual ones of the virtual tracks from said memory; and relating the performance data of individual ones of the virtual tracks, read out from said memory, to respective ones of the performance parts, with reference to the settings of the selected one of said tables.

14. A machine-readable storage medium as claimed in claim 13 wherein said program further comprises a step of controlling tone generation or visual display based on performance data, in accordance with corresponding relationship between the performance data of the individual virtual tracks and the performance parts set by said step of relating.

15. A music-performance setting apparatus comprising:

a memory storing performance data of a plurality of performance parts with each of the performance parts related with any of a plurality of virtual tracks which are specified by individual track information said performance data being accompanied by identifying information;

a table representing settings as to correspondence between the performance parts and the virtual tracks;

an operator unit; and a processor coupled with said memory, said table and said operator unit and adapted to:

change the settings of said table in response to said operation of said operator unit store the changed settings of said table in a buffer;

relate the performance data of the individual virtual tracks, read out from said memory, to respective ones of the performance parts with reference to the settings of said table stored in said buffer; and even when a changeover takes place in performance data to be performed, retain the changed settings stored in said buffer unless there is a change in identifying information accompanying with the performance data.

16. A music-performance setting apparatus comprising:

a memory storing performance data of a plurality of performance parts with each of the performance parts related with any of a plurality of virtual tracks which are specified by individual track information;

a table representing settings as to correspondence between the performance parts and the virtual tracks;

an operator unit; and a processor coupled with said memory, said table and said operator unit and adapted to:

change the settings of said table in response to operation of said operator unit;

perform control to read out the performance data of individual ones of the virtual tracks from said memory;

relate the performance data of the individual virtual tracks, read out from said memory, to respective ones of the performance parts, with reference to the settings of the table;

receive performance-part designating information entered by a user;

select a virtual track corresponding to a performance part designated by the performance-part designating information, with reference to the settings of said table; and perform control to generate tones, on the basis of the performance data of the individual virtual tracks read out from said memory, in such a manner that no tone is generated on the basis of the performance data of the selected virtual track corresponding to the performance part designated by the performance-part designating information.

17. A music-performance setting apparatus comprising:

a memory storing performance data of a plurality of performance parts with each of the performance parts related with any of a plurality of virtual tracks which are specified by individual track information;

a table representing settings as to correspondence between the performance parts and the virtual tracks;

an operator unit;

a display unit; and a processor coupled with said memory, said table, said operator unit and said display unit and adapted to:

change the settings of said table in response to operation of said operator unit;

perform control to read out the performance data of individual ones of the virtual tracks from said memory;

relate the performance data of the individual virtual tracks, read out from said memory, to respective ones of the performance parts, with reference to the settings of the table;

receive performance-part designating information entered by a user;

select a virtual track corresponding to a performance part designated by the performance-part designating information, with reference to the settings of said table; and cause said display unit to provide a visual performance guide display on the basis of the performance data of the selected virtual track corresponding to the performance part designated by the performance-part designating information.

18. A method of relating a plurality of performance parts and a plurality of virtual tracks with one another using a memory storing performance data of a plurality of performance parts with each of the performance parts related with any of a plurality of virtual tracks which are specified by individual track information, said performance data being accompanied by identifying information, and using a table representing settings as to correspondence between the performance parts and the virtual tracks, said method comprising the steps of:

changing the settings of said table as to the correspondence between the performance parts and the virtual tracks;

storing the changed settings of said table in a buffer;

relating the performance data of the individual virtual tracks, read out from said memory, to respective ones of the performance parts with reference to the settings of said table stored in said buffer; and even when a changeover takes place in performance data to be performed, retaining the changed settings stored in said buffer unless there is a change in identifying information accompanying with the performance data.

19. A method of relating a plurality of performance parts and a plurality of virtual tracks with one another using a memory storing performance data of a plurality of performance parts with each of the performance parts related with any of a plurality of virtual tracks which are specified by individual track information, and using and a table representing settings as to correspondence between the performance parts and the virtual tracks, said method comprising the steps of:

changing the settings of said table as to the correspondence between the performance parts and the virtual tracks;

performing control to read out the performance data of individual ones of the virtual tracks from said memory relating the performance data of the individual virtual tracks, read out from said memory, to respective ones of the performance parts, with reference to the settings of the table;

receiving performance-part designating information entered by a user;

selecting a virtual track corresponding to a performance part designated by the performance-part designating information, with reference to the settings of said table; and performing control to generate tones, on the basis of the performance data of the individual virtual tracks read out from said memory, in such a manner that no tone is generated on the basis of the performance data of the selected virtual track corresponding to the performance part designated by the performance-part designating information.

20. A method of relating a plurality of performance parts and a plurality of virtual tracks with one another using a memory storing performance data of a plurality of performance parts with each of the performance parts related with any of a plurality of virtual tracks which are specified by individual track information, and using a table representing settings as to correspondence between the performance parts and the virtual tracks, said method comprising the steps of:

changing the settings of said table as to the correspondence between the performance parts and the virtual tracks;

performing control to read out the performance data of individual ones of the virtual tracks from said memory;

relating the performance data of the individual virtual tracks, read out from said memory, to respective ones of the performance parts, with reference to the settings of the table;

receiving performance-part designating information entered by a user;

selecting a virtual track corresponding to a performance part designated by the performance-part designating information, with reference to the settings of said table; and providing a visual performance guide display on the basis of the performance data of the selected virtual track corresponding to the performance part designated by the performance-part—designating information.

21. A machine-readable storage medium containing a group of instructions of a program executable by a processor for relating a plurality of performance parts and a plurality of virtual tracks with one another, said processor being coupled with a memory storing performance data of a plurality of performance parts with each of the performance parts related with any of a plurality of virtual tracks which are specified by individual track information, said performance data being accompanied by identifying information, a table representing settings as to correspondence between the performance parts and the virtual tracks and an operator unit, said program comprising the steps of:

changing the settings of said table as to the correspondence between the performance parts and the virtual tracks, in response to operation of said operator unit;

storing the changed settings of said table in a buffer;

relating the performance data of the individual virtual tracks, read out from said memory, to respective ones of the performance parts with reference to the settings of said table stored in said buffer; and even when a changeover takes place in performance data to be performed, retaining the changed settings stored in said buffer unless there is a change in identifying information accompanying with the performance data.

22. A machine-readable storage medium containing a group of instructions of a program executable by a processor for relating a plurality of performance parts and a plurality of virtual tracks with one another, said processor being coupled with a memory storing performance data of a plurality of performance parts with each of the performance parts related with any of a plurality of virtual tracks which are specified by individual track information, a table representing settings as to correspondence between the performance parts and the virtual tracks and an operator unit, said program comprising the steps of:

changing the settings of said table as to the correspondence between the performance parts and the virtual tracks, in response to operation of said operator unit;

performing control to-read out the performance data of individual ones of the virtual tracks from said memory;

relating the performance data of the individual virtual tracks, read out from said memory, to respective ones of the performance parts, with reference to the settings of the table;

receiving performance-part designating information entered by a user;

selecting a virtual track corresponding to a performance part designated by the performance-part designating information, with reference to the settings of said table; and performing control to generate tones, on the basis of the performance data of the individual virtual tracks read out from said memory, in such a manner that no tone is generated on the basis of the performance data of the selected virtual track corresponding to the performance part designated by the performance-part designating information.

23. A machine-readable storage medium containing a group of instructions of a program executable by a processor for relating a plurality of performance parts and a plurality of virtual tracks with one another, said processor being coupled with a memory storing performance data of a plurality of performance parts with each of the performance parts related with any of a plurality of virtual tracks which are specified by individual track information, a table representing settings as to correspondence between the performance parts and the virtual tracks, an operator unit and a display unit, said program comprising the steps of:

changing the settings of said table as to the correspondence between the performance parts and the virtual tracks, in response to operation of said operator unit;

performing control to read out the performance data of individual ones of the virtual tracks from said memory;

relating the performance data of the individual virtual tracks, read out from said memory, to respective ones of the performance parts, with reference to the settings of the table;

receiving performance-part designating information entered by a user;

selecting a virtual track corresponding to a performance part designated by the performance-part designating information, with reference to the settings of said table; and causing said display unit to provide a visual performance guide display on the basis of the performance data of the selected virtual track corresponding to the performance-part designated by the performance-part designating information.

* * * * *